United States Patent [19]

Higton

[11] Patent Number: 4,672,264

[45] Date of Patent: Jun. 9, 1987

[54] HIGH CONTRAST ELECTROLUMINESCENT DISPLAY PANELS

[75] Inventor: Malcolm H. Higton, Poole, United Kingdom

[73] Assignee: Phosphor Products Company Limited, Poole, England

[21] Appl. No.: 741,118

[22] Filed: Jun. 4, 1985

Related U.S. Application Data

[63] Continuation-in-part of Ser. No. 689,720, Jan. 8, 1985, abandoned.

[51] Int. Cl.[4] ..... H05B 33/02; H05B 33/22

[52] U.S. Cl. ..... 313/503; 313/505; 313/509

[58] Field of Search ..... 313/506, 505, 509, 503

[56] References Cited

U.S. PATENT DOCUMENTS

| | | | |
|---|---|---|---|
| 4,137,481 | 1/1979 | Hilsum et al. | 313/506 X |
| 4,143,297 | 3/1979 | Fischer | 313/509 |

FOREIGN PATENT DOCUMENTS

| | | | |
|---|---|---|---|
| 0139281 | 6/1985 | European Pat. Off. . | |
| 0798504 | 7/1958 | United Kingdom . | |
| 893187 | 4/1962 | United Kingdom | 313/506 |
| 2017138 | 10/1979 | United Kingdom . | |
| 2039146 | 7/1980 | United Kingdom . | |
| 2133927 | 8/1984 | United Kingdom | 313/503 |
| 2135117 | 8/1984 | United Kingdom | 313/503 |

*Primary Examiner*—Palmer C. DeMeo
*Attorney, Agent, or Firm*—William R. Hinds

[57] ABSTRACT

A d.c. or a.c. electroluminescent panel comprises a transparent substrate, a transparent first electrode film, a thin film phosphor layer, a control layer and a second electrode film. A black or dark colored material, less than 1 micron thick, is interposed between the thin film phosphor layer and the control layer to enhance the contrast of the panel whenever a voltage is applied across the thin film phosphor layer causing it to emit light.

13 Claims, 2 Drawing Figures

HIGH CONTRAST ELECTROLUMINESCENT DISPLAY PANELS

RELATED APPLICATION

This application is a continuation-in-part of Application Ser. No. 689,720, filed Jan. 8, 1985, now abandoned.

BACKGROUND OF THE INVENTION

This invention relates to electroluminescent (EL) phosphor panels and displays designed for unidirectional voltage operation, known as DCEL panels.

DESCRIPTION OF THE PRIOR ART

Thick film powder DCEL panels (which are also capable of ACEL operation) are conventionally manufactured by a process comprising the steps of:

(a) depositing a transparent front electrode film e.g. of tin oxide, onto a transparent insulating substrate, e.g. glass;

(b) spreading an active layer, comprising phosphor particles, such as zinc sulphide (ZnS) doped with an activator such as manganese (Mn) and coated with copper suspended in a binder medium, on the front electrode; this layer is typically 10–50 μm thick (hence 'thick film' device);

(c) depositing a back electrode film, e.g. of aluminium on the active layer;

(d) applying a unidirectional voltage to the electrode films for a predetermined time, so that in the region of the positively biased front electrode the copper coating is stripped from phosphor particles to form a high resistivity, high light output layer, typically 1–2 μm thick. The relatively thick layer of unstripped phosphor particles then remaining behind this thin light-emitting layer constitutes a highly conductive control layer.

The last step, (d) in the manufacturing process, is known as 'forming' and is more particularly described in U.K. Pat. No. 1,300,548. The electrodes can of course be laid down in any desired shape to produce a particular display, e.g. if the electrodes comprise mutually perpendicular strips a matrix of active phosphor elements, or 'dots' will be defined each of which may be addressed and driven using conventional electronic techniques to form alphanumeric characters. Having such a process we have designed and built a 2000 character DCEL panel suitable for use with a computer as a monitor display and replacing the conventional bulky cathode ray tube monitor display.

A disadvantage of the all powder panels is that the display elements can presently only produce a light output which, whilst acceptable in all but the highest ambient light conditions, is difficult to maintain throughout the life of the display. Moreover, since the quiesent colour of the phosphor material is a very light shade of grey such high light output levels are required to provide an adequate display contrast.

The powder panels described above are known as 'self-healing', i.e. the copper-coated powder backlayer, the control layer, protects the thin, high resistance, light-emitting 'formed' layer from catastrophic breakdown due to excessive current density at defects or points of weakness by further copper stripping or 'forming' at such 'hot spots'.

To ensure a more reproducible manufacturing technique, not requiring the expensive and time-consuming forming operations, a composite thin film power electroluminecent panel has been proposed (see 'A Composite ZnS Thin Film Powder Electroluminescent Panel' C. J. Alder et al, Displays, January 1980, at page 191). Such panels are in effect a hybrid structure in which a thin film, equivalent to the light-emitting formed layer in conventional DCEL panels, is coated with the copper coated phosphor backlayer, i.e. control layer. The thin film is of semi-insulating activator-doped phosphor, such as ZnS doped with Mn, and is typically 200 A to 1 μm thick. This light-emitting film is deposited onto the transparent front electrode of the panel by sputtering, evaporation, electrophoretic plating or any of the known ways of depositing thin films on substrates. The conventional control layer and the back electrode are spread and vacuum-deposited onto the light-emitting film in the known manner. The control layer need not contain Mn since the light emitted by the device originates from the thin film. U.S. Pat. No. 4,137,481 describes such a hybrid panel which may or may not require the application of a forming current before it is ready for use. If a forming current is required, forming is found to occur at much lower current densities than those required for conventional thick film DCEL panels.

The hybrid DCEL panel is protected by the control layer from catastrophic breakdown due to excessive current density at defects and points of weakness by retaining its forming properties in the same way as the thick film powder only DCEL panels. However the known hybrid panels using conventional control layers still suffer from the effects of further forming during extensive use leading to brightness degradation with time. Again, the contrast provided by such known hybrid devices is poor.

It is an object of the present invention to provide a thin film powder composite DCEL (hybrid) panel with improved brightness maintenance during its operational lifetime and providing siginficant contrast enhancement.

SUMMARY OF THE INVENTION

According to the present invention, an electroluminescent d.c. panel includes in serial order, a transparent electrically insulating substrate, a transparent first electrode film, a first thin film layer of semi-insulating self-activated or activator-doped phosphor, a second layer of black or dark coloured, electrically resistive material and a third layer comprising an electrically conducting powder control layer, the said second layer having an average thickness of less than 1 micron and effective to provide contrast enhancement and to allow injection of electrons thereacross from said powder control layer into said first thin film layer.

The third or control layer is preferably elected from the group consisting of transition metal oxides, transition metal sulfides, rare earth metal oxides and rare earth metal sulfides.

The second layer, hereinafter referred to as the thin film interlayer, may be for example ZnTe (dark brown), CdTe (black), CdSE (black/brown), a Chalcogenide glass (black), or $Sb_2S_3$ (black/brown), or any other suitable dark material, e.g. a compound of a transition metal or of a rare earth metal, e.g. an oxide sulfide or other Chalcogenide, for example PbS, PbO, CuO, $MnO_2$, $Tb_4O_7$, $Eu_2O_3$, $PrO_2$ or $Ce_2S_3$.

BRIEF DESCRIPTION OF THE DRAWING

The invention will now be described by way of example and with reference to the accompanying drawing, wherein.

DESCRIPTION OF THE PREFERRED EMBODIMENTS

Figure 1:
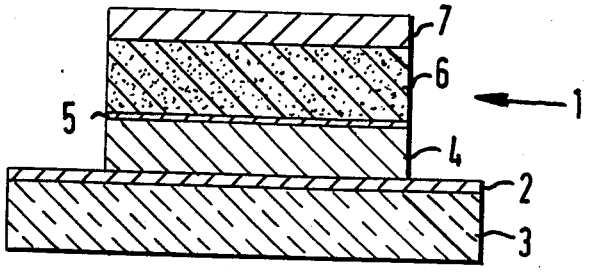
FIG. 1 is a cross-sectional view of an EL panel.

Referring to FIG. 1, the panel, indicated by reference numeral 1 includes a transparent tin oxide or indium tin oxide electrode 2 laid for example, by sputtering, on part of the upper surface of a glass substrate 3. The electrode 2 can be etched to any desired shape or pattern depending on the type of display required; for example the display required may be a dot matrix display in which case the electrode 2 will take the form of a plurality of parallel strips of width and spacing determined by the desired 'dot' (pixel) size.

A semi-insulating thin film 4 of self-activated or activator-doped phosphor, not more than 5 microns thick, is deposited on the electrode 2. The film for example may be ZnS activated with Mn in which case the display will exhibit a yellow colour in operation. Alternative colours may be effected by using activators other than Mn in ZnS, and other lattices with Mn and activators such as rare earth metals. For example, other phosphor lattices which may also be used are the alkaline earth sulphides e.g. BaS, CaS, SrS, fluorides such as $LaF_3$ and $YF_3$, oxides such as $Y_2O_3$ or any other suitable phosphor.

A black thin film interlayer 5, not more than 1 micron thick, is deposited on the thin film light emitting layer 4. The interlayer 5 may be for example ZnTe (dark brown), CdTe (black), CdSe (black/brown), a Chalcogenide glass (black), or $Sb_2S_3$ (black/brown), or any other suitable dark material. The interlayer 5 enables the combination of contrast enhancement and the current-controlling properties associated with a control layer 6.

The control layer 6 is a conventional layer of copper coated activated phosphor powder suspended in a binder medium, e.g. ZnS:Mn. It could also however, be a non-activated, copper coated phosphor powder so suspended; but preferably it is a high contrast layer of the type described in the aforesaid co-pending application. The control layer 6 is deposited on the interlayer 5.

An aluminum electrode is deposited, for example, by evaporation, onto the control layer 6. This electrode can be mechanically scribed to provide a shape corresponding or related to the electrode 2 to form the desired display pattern, for example, if a dot matrix display is required the electrode 7 will take the form of a plurality of parallel strips mutually perpendicular to the strips of electrode 2 so that the 'intersection' of the two sets of strips define the display pixels. If the control layer 6 is conductive, the electrode 7 can be omitted and means can then be provided for supplying electrical power direct to the control layer.

In operation, a DC or AC voltage typically between 20 and 200 V is applied across the electrodes 7 and 2.

Electrode 2 can be either positively or negatively biased. Light is emitted from the thin film 4 in a pattern determined by the electrode shape. The contrast between the light-emitting regions of the thin film 4 and the non-light-emitting regions is enhanced by the black interlayer 5 so that the display may be read by an observer even in relatively high ambient light conditions and with 'display brightness' of only a few foot lamberts, typically 4–8 fL. The presence of the black interlayer 5 may reduce brightness and efficiency, but this is more than compensate for by the improved contrast ratio.

For Chalcogenide glass, however, as the interlayer, practical levels of brightness of over 80 fL with efficiencies of 0.01–0.02% W/W have been achieved. Contrast ratios of 14:1 have been reported for 50 fL brightness, in ambient light conditions of 100 fL.

Figure 2:
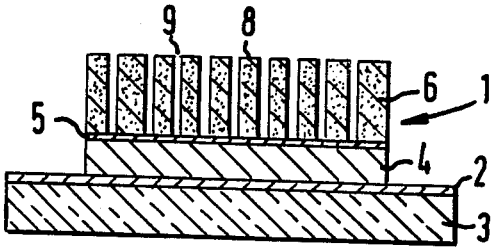
FIG. 2 is a cross-sectional view of an alternative EL panel.

The panel shown in FIG. 2 is identical to that shown in FIG. 1 (and like reference numbers have been used to indicated like parts) with the exception that the rear electrodes 7 have been omitted and the powder layer 6 has been formed into discrete ridges 8 separated by furrows or grooves 9. An electrical connection (not shown) is made to each of the ridges 8 of the powder layer 5.

The embodiment shown in FIG. 2 is intended for multiplex addressing on an X-Y matrix and so transparent electrode film 2 is formed in strips running perpendicular to (or intersecting) the furrows 9.

The black interlayer 5 may be conductive, semi-conductive or insulating and if conductive, the grooves 9 should of course extend through the interlayer. The same may be true if the interlayer is semi-conductive but this depends on the conductivity of the layer concerned.

The interlayer 5 may be made of a material that has self-healing properties, i.e. a material that changes conductivity in response to applied voltage, but this is not necessary since the control powder layer 6 can act through the interlayer 5 to provide these properties. In this case, the interlayer must be sufficiently thin to allow the control layer 6 to act through the interlayer but not so thin as to mean that the interlayer loses its dark colour.

I claim:

1. An electroluminescent phosphor panel suitable for both undirectional and alternating voltage operations comprising, in serial order, a transparent electrically insulating substrate, a transparent first electrode film, a first thin film layer of semi-insulating self-activated or activator-doped phosphor, a second layer of black or dark coloured, electrically resistive material, and a third layer comprising an electrically conducting powder control layer, the said second layer having an average thickness of less than 1 micron and effective to provide contrast enhancement and to allow injection of electrons thereacross from said powder control layer into said first thin film layer.

2. A panel according to claim 1 and wherein said second layer comprises a material selected from the group consisting of ZnTe, CdTe, CdSe, Chalcogenide glass and $Sb_2S_3$.

3. A panel according to claim 1 which further comprises a second electrode film in contact with the side of the third layer remote from the substrate.

4. A panel according to claim 1, wherein said second layer is a thin film layer.

5. A panel according to claim 1, wherein the powder of the third layer is selected from the group consisting of transition metal oxides, transition metal sulfides, rare earth metal oxides and rare earth metal sulfides.

6. A panel according to claim 1, wherein the powder of the third layer is selected from the metal chalcogenides.

7. A panel according to claim 1, wherein the powder of the third layer is selected from metal oxides.

8. A panel according to claim 1, wherein the powder of the third layer is selected from metal sulfides.

9. A panel according to claim 1, wherein the powder of the third layer is selected from the group consisting of PbS, PbO, CuO, $MnO_2$, $Tb_4O_7$, $Eu_2O_3$, $PrO_2$ and $Ce_2S_3$.

10. A panel according to claim 1, wherein the powder of the third layer is selected from the group consisting of non-emitting phosphor materials and non-activator-doped phosphor materials.

11. A panel according to claim 1, wherein the band gap of the third layer is less than 2 eV.

12. A panel according to claim 1, wherein the band gap of the third layer is less than 1.8 eV.

13. A panel according to claim 1, wherein the third layer is composed of discrete ridges separated from each other by furrows.

* * * * *